US007763322B2

(12) United States Patent
Rüther et al.

(10) Patent No.: US 7,763,322 B2
(45) Date of Patent: Jul. 27, 2010

(54) METHOD FOR OVERPAINTING COLOR AND/OR EFFECT MULTI-LAYER PAINTS

(75) Inventors: Andreas Rüther, Senden (DE); Anja Loewe, Münster (DE)

(73) Assignee: BASF Corporation, Munster (DE)

( * ) Notice: Subject to any disclaimer, the term of this patent is extended or adjusted under 35 U.S.C. 154(b) by 935 days.

(21) Appl. No.: 10/511,080

(22) PCT Filed: Apr. 28, 2003

(86) PCT No.: PCT/EP03/04392

§ 371 (c)(1),
(2), (4) Date: Oct. 12, 2004

(87) PCT Pub. No.: WO03/095566

PCT Pub. Date: Nov. 20, 2003

(65) Prior Publication Data

US 2005/0129871 A1 Jun. 16, 2005

(30) Foreign Application Priority Data

May 8, 2002 (DE) ..... 102 20 414

(51) Int. Cl.
*B05D 1/04* (2006.01)
*B05D 7/00* (2006.01)

(52) U.S. Cl. ..... 427/402; 427/372.2; 427/379; 427/384; 427/385.5; 427/407.1; 427/421.1; 427/458

(58) Field of Classification Search ..... 427/402, 427/407.1, 458, 421.1, 372.2, 384, 385.5
See application file for complete search history.

(56) References Cited

U.S. PATENT DOCUMENTS

| | | | | |
|---|---|---|---|---|
| 5,281,468 | A | 1/1994 | Klier et al. | |
| 5,368,944 | A * | 11/1994 | Hartung et al. | 428/423.1 |
| 5,633,037 | A * | 5/1997 | Mayer | 427/140 |
| 6,168,864 | B1 * | 1/2001 | Sakamoto et al. | 428/413 |
| 6,495,201 | B2 * | 12/2002 | Duda et al. | 427/142 |
| 2003/0108681 | A1 | 6/2003 | Woltering et al. | |
| 2004/0115356 | A1 | 6/2004 | Zarse et al. | |
| 2007/0116866 | A1 * | 5/2007 | Mich | 427/140 |
| 2008/0235224 | A1 * | 9/2008 | Joseph Rodrigues et al. | 707/6 |

FOREIGN PATENT DOCUMENTS

| | | |
|---|---|---|
| EP | 217385 | 4/1987 |
| GB | 2297049 | 7/1996 |
| WO | WO9109686 | 7/1991 |
| WO | WO0162401 | 8/2001 |
| WO | WO02094955 | 11/2002 |

* cited by examiner

*Primary Examiner*—Elena T Lightfoot
(74) *Attorney, Agent, or Firm*—Cantor Colburn LLP

(57) ABSTRACT

A process for overcoating multicoat paint systems comprising (1) applying by pneumatic spray application to the multicoat paint systems the extract, free from opaque pigments, of an aqueous basecoat material (A) or of a corresponding aqueous basecoat material, (2) flashing off and/or drying the resulting film (1) without curing it completely, (3) coating by pneumatic spray application at a reduced spraying pressure the resulting flashed off and/or dried film (2) with the aqueous basecoat material (A) or a ' corresponding aqueous basecoat material, (4) flashing off and/or drying the resulting aqueous basecoat film (3) without curing it completely, (5) coating the resulting flashed off and/or dried aqueous basecoat film (4) with a liquid clearcoat material, and (6) jointly curing the film (1), and, where resulting clearcoat film (5), the aqueous basecoat film (4) and the appropriate, any further uncured films that are present.

17 Claims, No Drawings

METHOD FOR OVERPAINTING COLOR AND/OR EFFECT MULTI-LAYER PAINTS

CROSS REFERENCE TO RELATED APPLICATIONS

This application is a National Phase Application of Patent Application of PCT/EP03/04392 filed 28 Apr. 2003, which claims priority to DE 102 20 414.4, filed on 8 May 2002, both of which are incorporated herein by reference.

BACKGROUND

The present invention relates to a novel process for overcoating multicoat color and/or effect paint systems comprising at least one color and/or effect basecoat (A) produced from at least one aqueous basecoat material (A) and at least one clearcoat (B) produced from at least one liquid clearcoat material (B). The present invention relates in particular to a novel process for overcoating, on the line at the automaker's plant, damaged or undamaged multicoat color and/or effect paint systems produced by means of electrostatic spray application (ESTA).

In the overcoating of multicoat color and/or effect paint systems on motor vehicles, especially automobiles, with refinishes there are often shifts in shade and/or changes in the optical effect, especially the metallic effect. In many cases the cause of these unwanted changes is the fact that the multicoat paint systems, also referred to by those in the art as original finishes or OEM finishes, are applied by means of electrostatic spray application (ESTA) whereas the refinishes are applied pneumatically. The different application methods lead in fact to a difference in the orientation of the color and/or effect pigments in the resultant basecoats.

The basic assumption in the art is that a shade and/or optical effect produced by ESTA application cannot be copied pneumatically.

In order to prevent at least partly the shift in shade and change in optical effect, OEM finishes are refinished on the line at the automaker's plant using conventional basecoat materials, i.e., based on materials comprising organic solvents, whose shade and/or optical effect are adapted to those of the basecoats to be refinished. However, this approach is very complicated, since a conventional basecoat material has to be prepared and stocked at the automaker's plant separately for every production shade and/or effect.

European patent EP 0 521 040 B2 discloses a process for producing a multicoat refinish system in the conventional sense, in which a pigment-free, aqueous, film-forming coating composition is first applied in the region of the defect in the OEM finish, followed by an aqueous refinish basecoat material. The coating composition may be a pigment-free extract of the aqueous refinish basecoat material. A clearcoat material is then applied wet on wet to the aqueous basecoat film, after which the films present are cured together. This process constitutes a significant advance in refinish in the conventional sense.

The known refinish process, however, is unable to solve the above-mentioned problems which occur when multicoat color and/or effect paint systems are overcoated on the line at the automaker's plant, since said overcoating requires quite different amounts of coating materials and an entirely different logistical system than for refinish in the conventional sense, which of course is carried out above all in vehicle finishing workshops.

It is an object of the present invention to provide a novel process for overcoating multicoat color and/or effect paint systems, especially multicoat paint systems which have been produced by means of electrostatic spray application (ESTA) and curing and comprise at least one color and/or effect basecoat (A) produced from at least one aqueous basecoat material (A) and at least one clearcoat (B) produced from at least one liquid clearcoat material (B), said process no longer having the disadvantages of the prior art but instead giving multicoat color and/or effect paint systems, applied pneumatically wet on wet and cured, which suffer no deleterious shift in shade and/or no deleterious change in optical effect, especially metallic effect, as compared with the original or OEM finishes. Moreover, it is intended that the multicoat paint systems produced by means of the novel process should adhere very well to the OEM finishes. Not least, it is intended that the novel process should be suitable in particular for the overcoating of OEM finishes on the line at the automaker's plant, where the problems occurring are quite different to those associated with automotive refinish in the conventional sense.

SUMMARY OF THE INVENTION

The invention accordingly provides the novel process for overcoating multicoat color and/or effect paint systems comprising at least one color and/or effect basecoat (A) produced from at least one aqueous basecoat material (A) and at least one clearcoat (B) produced from at least one liquid clearcoat material (B), which comprises (1) applying to the outer surface of the multicoat paint systems by pneumatic spray application the extract of an aqueous basecoat material, substantially or entirely free from opaque pigments, which substantially corresponds or is identical to the aqueous basecoat material (A) or one of the aqueous basecoat materials (A) from which the basecoat (A) was produced, (2) flashing off and/or drying the resulting film (1) without curing it completely, (3) coating the film by pneumatic spray application at a reduced spraying pressure with an aqueous basecoat material which substantially corresponds or is identical to the aqueous basecoat material (A) or one of the aqueous basecoat materials (A) from which the basecoat (A) was produced, (4) flashing off and/or drying the resulting aqueous basecoat film (3) without curing it completely, (5) coating the resulting flashed off and/or dried aqueous basecoat film (4) with at least one clearcoat material, and (6) jointly curing the resulting clearcoat film(s) (5), the aqueous basecoat film (4) and the film (1), and, where appropriate, any further uncured films that are present.

The novel process for overcoating multicoat color and/or effect paint systems comprising at least one color and/or effect basecoat (A) produced from at least one aqueous basecoat material (A) and at least one clearcoat (B) produced from at least one liquid clearcoat material (B) is referred to below as "process of the invention".

DETAILED DESCRIPTION

In the light of the prior art it was surprising and unforeseeable for the skilled worker that the object on which the present invention was based could be achieved by means of the process of the invention. A particular surprise was that the multicoat color and/or effect paint systems with which the OEM finishes were overcoated no longer exhibited any deleterious shift in shade and/or any deleterious change in optical effect, especially metallic effect, even when the OEM finishes had been produced by means of electrostatic spray application (ESTA). This meant that, contrary to the opinion of the art, it was indeed surprisingly possible to copy pneumatically the shades and optical effects produced by means of ESTA application. A particular surprise was that the multicoat paint systems produced by the process of the invention exhibited outstanding adhesion to the OEM finishes.

The process of the invention is used for overcoating multicoat color and/or effect paint systems, preferably color and effect paint systems or just effect paint systems. This overcoating can be done for repair purposes, if for example the multicoat paint systems have been damaged by mechanical and/or chemical exposure. However, overcoating may also be carried out on undamaged multicoat paint systems if, for example, a change, particularly an adaptation, of the color and/or optical effect is required.

The purpose of the multicoat paint systems may be protection, decoration, increasing the mar resistance and abrasion resistance and corrosion resistance, improving the cleaning properties, improving the mold release and reducing the clinging, producing an antimisting effect, producing antireflective properties and/or raising the bursting pressure. They may be used on any of a very wide variety of substrates. Accordingly, the substrates in question may comprise metal, plastic, glass, ceramic, porcelain, clay, concrete, natural stone, artificial stone, wood, paper, textile, leather, and composites of these materials. The substrates in question are preferably of metal or plastic.

The multicoat paint systems may be used accordingly in numerous industrial fields, such as for the painting of motor vehicle bodies and parts thereof, the interior and exterior of motor vehicles, the interior and exterior of buildings, doors, windows, furniture, and hollow glassware, and, in the context of industrial coating, for the coating of small parts, coils, containers, packaging, electrical components and wide goods.

With preference, the multicoat paint systems serve for protecting and decorating motor vehicle bodies, especially automobile bodies. The automobile paint system comprising the multicoat color and/or effect paint systems, as defined in Römpp Lexikon Lacke und Druckfarben, Georg Thieme Verlag, Stuttgart, New York, 1998, page 50, "Automobile finishing", is composed in general of electrocoat, primer coat, surfacer coat or antistonechip primer coat, basecoat, and clearcoat.

Use of the multicoat color and/or effect paint systems as automobile systems presupposes what is known as automobile quality. According to European patent EP 0 352 298 B1, page 15 line 42 to page 17 line 14, this means that the multicoat color and/or effect paint systems in question exhibit (1) high gloss,
(2) high distinctiveness of image,
(3) high and uniform hiding power,
(4) a uniform dry film thickness,
(5) high gasoline resistance,
(6) high solvent resistance,
(7) high acid resistance,
(8) a high level of hardness,
(9) high abrasion resistance,
(10) high mar resistance,
(11) high impact strength,
(12) a high level of intercoat adhesion and adhesion to the substrate, and
(13) high weathering stability and UV resistance.

These prerequisites must be met not only by the multicoat color and/or effect paint systems present on the bodies of the motor vehicles but also by those which are present on exterior mounted components, such as protective metal panels, wings, doors, trunk lids, spoilers or lamp reflectors produced not from metal but instead from plastics, especially fiber reinforced plastics, SMC (sheet molding compounds), BMC (bulk molding compounds), IMC (injection molding compounds), and RIMC (reaction injection molding compounds).

As is known, the multicoat color and/or effect paint systems are produced by applying to the electrocoated motor vehicle bodies or exterior mounted components a primer or surfacer which in the great majority of cases is cured thermally by itself. The resulting surfacer coat or antistonechip primer coat is then overcoated by the technique known as wet on wet with at least one, especially one, aqueous basecoat material (A) and at least one, especially one, liquid clearcoat material (B), preferably by electrostatic spray application (ESTA; cf. Römpp Lexikon Lacke und Druckfarben, Georg Thieme Verlag, Stuttgart, New York, 1998, page 186, "Electrostatic coating", and page 187, "Electrostatic spraying"), after which the resulting films are cured conventionally and jointly, thermally or both thermally and with actinic radiation. Actinic radiation used can be electromagnetic radiation, such as near infrared (NIR), visual light, UV radiation or X-rays, especially UV radiation, and/or corpuscular radiation, such as electron beams.

As aqueous basecoat materials (A) it is possible to use all customary and known aqueous basecoat materials such as are normally used for producing multicoat color and/or effect paint systems for the OEM finishing of automobiles in particular by the wet on wet technique.

Highly suitable aqueous basecoat materials (A) are known, for example, from patent applications EP 0 089 497 A1, EP 0 256 540 A1, EP 0 260 447 A1, EP 0 297 576 A1, WO 96/12747, EP 0 523 610 A1, EP 0 228 003 A1, EP 0 397 806 A1, EP 0 574 417 A1, EP 0 531 510 A1, EP 0 581 211 A1, EP 0 708 788 A1, EP 0 593 454 A1, DE-A-43 28 092 A1, EP 0 299 148 A1, EP 0 394 737 A1, EP 0 590 484 A1, EP 0 234 362 A1, EP 0 234 361 A1, EP 0 543 817 A1, WO 95/14721, EP 0 521 928 A1, EP 0 522 420 A1, EP 0 522 419 A1, EP 0 649 865 A1, EP 0 536 712 A1, EP 0 596 460 A1, EP 0 596 461 A1, EP 0 584 818 A1, EP 0 669 356 A1, EP 0 634 431 A1, EP 0 678 536 A1, EP 0 354 261 A1, EP 0 424 705 A1, WO 97/49745, WO 97/49747, EP0 401 565 A1, EP 0 496 205 A1, EP 0 358 979 A1, EP 469 389 A1, DE 24 46 442 A1, DE 34 09 080 A1, DE 195 47 944 A1, DE 197 41 554.7 A1 or EP 0 817 684, column 5, lines 31 to 45. They preferably contain at least one ionically and/or nonionically stabilized polyurethane binder which is saturated, unsaturated and/or grafted with olefinically unsaturated compounds. They may further comprise at least one crosslinking agent. The crosslinking agent is preferably selected from the group consisting of amino resins, blocked polyisocyanates, and tris(alkoxycarbonylamino)triazines.

Suitable liquid clearcoat materials (B) for producing the clearcoats include all customary and known one-component (1K), two-component (2K) or multicomponent (3K, 4K) clearcoat materials, powder slurry clearcoat materials, UV-curable clearcoat materials, and sealers.

Thermally curable one-component (1K), two-component (2K) or multicomponent (3K, 4K) clearcoat materials (B) are known from patent applications DE 42 04 518 A1, EP 0 594 068 A1, EP0 594 071 A1, EP0 594 142 A1, EP 0 604 992 A1 or EP0 596 460 A1, from international patent applications WO 94/10211, WO 94/10212, WO 94/10213, WO 94/22969 or WO 92/22615, or from American patents U.S. Pat. Nos. 5,474,811 A1, 5,356,669 A1 or 5,605,965 A1.

One-component (1K) clearcoat materials (B), especially solventbornes, comprise, as is known, hydroxyl-containing binders and crosslinking agents, that is blocked polyisocyanates, tris(alkoxycarbonylamino)triazines and/or amino resins. In a further variant they comprise as binders polymers containing pendant carbamate and/or allophanate groups and, where appropriate, carbamate- and/or allophanate-modified amino resin crosslinking agents (cf. American patents U.S. Pat. Nos. 5,474,811 A1, 5,356,669 A1 or 5,605,965 A1, international patent applications WO 94/10211, WO 94/10212 or WO 94/10213 or European patent applications EP 0 594 068 A1, EP 0 594 071 A1 or EP 0 594 142 A1).

Two-component (2K) or multicomponent (3K, 4K) clearcoat materials (B), especially solventbornes, include as essential constituents, as is known, hydroxyl-containing binders and polyisocyanate crosslinking agents, which are stored separately until such time as they are used.

Thermally curable powder slurry clearcoat materials (B) are known, for example, from American patent U.S. Pat. No. 4,268,542 A1 and from German patent applications DE 195 18 392 A1, DE 198 14 471 A1, and DE 196 13 547 A1.

Powder slurry clearcoat materials (B) contain, as is known, powder clearcoat materials dispersed in an aqueous medium.

UV-curable clearcoat materials (B) are disclosed, for example, in European patent applications EP 0 928 800 A1, EP 0 636 669 A1, EP 0 410 242 A1, 0 783 534 A1, EP 0 650 978 A1, EP 0 650 979 A1, EP 0 650 985 A1, EP 0 540 884 A1, EP 0 568 967 A1, EP 0 054 505 A1 or EP 0 002 866 A1, German patent applications DE 197 09 467 A1, DE 42 03 278 A1, DE 33 16 593 A1, DE 38 36 370 A1, DE 24 36 186 A1 or DE 20 03 579 B1, international patent applications WO 97/46549 or WO 99/14254, or American patents U.S. Pat. Nos. 5,824,373 A1, 4,675,234 A1, 4,634,602 A1, 4,424,252 A1, 4,208,313 A1, 4,163,810 A1, 4,129,488 A1, 4,064,161 A1 or 3,974,303 A1.

Also known are clearcoat materials (B) which can be crosslinked thermally and with actinic radiation (cf. patent applications EP 0 982 800 A1, EP 0 844 286 A1, WO 98/40170, and DE 199 14 896 A1), this being referred to by those in the art, inter alia, as dual cure. Examples of suitable dual-cure clearcoat materials (B) are one- or two-component clearcoat materials which additionally contain functional groups which can be activated with actinic radiation and/or additional constituents containing such functional groups. Particular preference is given to using acrylate groups as functional groups which can be activated with actinic radiation. Examples of suitable additional constituents are isocyanato acrylates, urethane acrylates or polyfunctional acrylates, such as dipentaerythritol pentaacrylate.

Examples of suitable sealers (B) are known from German patents DE 43 03 570 A1, DE34 07 087 A1, DE40 11 045 A1, DE40 25 215 A1, DE38 28 098 A1, DE40 20 316 A1 or DE 41 22 743 A1. Also suitable are organically modified ceramic materials, which are sold under the brand name ORMOCER®.

Particular preference is given to using conventional one-component clearcoat materials (B), two-component clearcoat materials (B), and dual-cure clearcoat materials (B).

In the first step of the process of the invention, where appropriate following preparation of the defect or defects present by cleaning and/or abrading, the outer surface of an OEM finish is coated by pneumatic spray application (cf. Römpp Lexikon Lacke und Druckfarben, Georg Thieme Verlag, Stuttgart, New York, 1998, page 537, "Spray gun") with at least one extract of an aqueous basecoat material that is substantially or completely free from opaque pigments, especially a completely pigment-free extract, substantially corresponding or identical to the aqueous basecoat material (A) or one of the aqueous basecoat materials (A) from which the basecoats (A) were produced.

The aqueous basecoat material is regarded as "substantially corresponding" to the aqueous basecoat material (A) if the two materials coincide substantially or completely in the key constituents which shape the technological properties.

For the purposes of the invention, therefore, an extract is a coating material which comprises the same binder or binders and, where appropriate, the same crosslinking agent or agents as the aqueous basecoat material (A) in question. The concentration of the binders and, where appropriate, of the crosslinking agents in the extract may be the same as or may differ from the concentration in the parent aqueous basecoat material (A). Preferably, lower concentrations are employed in the extracts than in the corresponding aqueous basecoat material (A). Moreover, the extract may comprise the same additives, in the same amounts or in different amounts, as the aqueous basecoat material (A) in question, with the possible omission of the use of grinding resins. Additionally, additives other than those used in the aqueous basecoat material (A) may be employed.

For the purposes of the present invention, substantially free from opaque pigments" means that the extract in question, based on its total amount, may contain up to 20%, preferably up to 10%, and in particular up to 5% by weight of opaque color pigments, since this may facilitate color matching in the case of extensive overcoating of multicoat paint systems, especially OEM finishes. Preferably, however, the extract is a clearcoat material, completely free from opaque pigments, which may comprise nonopaque, transparent pigments. In particular, the extract is a pigment-free clearcoat material.

For the present invention it is essential that the extract corresponds in the abovementioned sense to the aqueous basecoat material (A) or one of the aqueous basecoat materials (A) from which the basecoat (A) of the multicoat paint system was produced.

In the first step of the process the extract is applied pneumatically, with spray application being carried out preferably with a spraying pressure of from 2.5 to 5 bar. The extract is preferably applied in a total film thickness such that curing thereof in the last step of the process results in a dry film thickness of from 2 to 50 μm, with particular preference from 5 to 45 μm, and in particular from 5 to 40 μm.

In the second step of the process, the resulting film of the extract is flashed off and/or dried without being cured completely.

In accordance with the invention, in the subsequent course of the process of the invention, the flashed off and/or dried film is coated by pneumatic spray application at a reduced spraying pressure with an aqueous basecoat material which substantially corresponds or is identical to the aqueous basecoat material or one of the aqueous basecoat materials (A) from which the basecoat (A) was produced. The aqueous basecoat material is regarded as "substantially corresponding" to the aqueous basecoat material (A) if the two basecoat materials substantially or completely coincide in the key constituents which shape the technological properties.

It is preferred to employ a spraying pressure of from 0.3 to 2.3, more preferably from 0.3 to 2, with particular preference from 0.3 to 1.8, and in particular from 0.5 to 0.9 bar.

The aqueous basecoat material is preferably applied in a total wet film thickness such that curing thereof in the last step of the process results in a dry film thickness totaling from 5 to 50 μm, preferably from 7.5 to 40 μm, and in particular from 10 to 30 μm.

In the next step of the process the resulting aqueous basecoat film is flashed off and/or dried without being cured completely.

Flashing off and/or drying the above-described films of the extract and the aqueous basecoat material may be accelerated in conventional manner by raising the temperature of the films, passing laminar air flows over the films and/or reducing the humidity of the ambient atmosphere.

In accordance with the invention, in a further step of the process, the flashed off and/or dried aqueous basecoat film is coated with at least one, especially one, liquid clearcoat material.

Preference is given to using a liquid clearcoat material which is curable thermally and/or with actinic radiation, preferably thermally or both thermally and with actinic radiation. Particular preference is given to using clearcoat materials which substantially correspond or are identical to the above-described aqueous or conventional, especially conventional, one-component, two-component or dual-cure clearcoat materials (B). The clearcoat materials and the clearcoat materials (B) are regarded as "corresponding substantially" to one another when they coincide substantially or completely in their key constituents which shape the technological properties. With very particular preference, the clearcoat materials are identical with the clearcoat materials (B) from which the clearcoats (B) of the multicoat paint systems were produced.

Pneumatic spray application takes place preferably at a spraying pressure of from 2.5 to 5 bar.

The resulting clearcoat film(s) is (are) preferably applied in a total wet film thickness such that curing thereof in the last step of the process results in a total dry film thickness of from 10 to 100 μm, more preferably from 15 to 80 μm, with particular preference from 20 to 70 μm, and in particular from 25 to 60 μm. Before curing in the last step of the process the clearcoat film(s) is (are) preferably flashed off and/or dried in conventional manner, in which case it is possible to employ the measures described above for accelerating the flashing off and/or drying process.

In accordance with the invention, in the last step of the process, the resulting clearcoat film(s), the aqueous basecoat film, and the film of the extract, and also, where appropriate, any further uncured films present, are jointly cured. The films are preferably cured thermally or both thermally and with actinic radiation, in which case it is possible to employ the customary and known techniques and apparatus.

The process of the invention may be used for overcoating the entire area of undamaged and damaged multicoat paint systems, especially OEM finishes. In the case of the damaged multicoat paint systems the defects and also all of the adjacent area up to a boundary, such as an edge or a trim strip, are overcoated.

The resultant secondary finishes adhere outstandingly to the multicoat paint systems and exhibit no unwanted shifts in shades and/or changes to the optical effects, especially the metallic effects. Moreover, the process of the invention is particularly economic, since the same starting materials are used for preparing the extracts of the aqueous basecoat materials (A) as for the aqueous basecoat materials (A) themselves and the same aqueous basecoat materials (A) are used for producing the secondary finishes as for producing the multicoat paint systems. The economics can be enhanced even further by using the same clearcoat materials for producing the secondary finishes as for producing the clearcoats (B) of the multicoat OEM paint systems. Overall, it is possible by means of the process to achieve significant simplification in stock keeping in the coating plants.

What is claimed is:

1. A process for overcoating a multicoat color and/or effect paint system, wherein the process is carried out on a line at an automaker's plant and wherein the multicoat color and/or effect paint system, which is an OEM finish on a motor vehicle produced by means of electrostatic spray application, comprises at least one color and/or effect basecoat (A) produced from at least one aqueous basecoat material (A) and at least one clearcoat (B) produced from at least one liquid clearcoat material (B), the process comprising:

(1) applying to an outer surface of the multicoat paint system by pneumatic spray application a clearcoat material that is an extract of an aqueous basecoat material, which substantially corresponds or is identical to the at least one aqueous basecoat material (A) from which the basecoat (A) was produced, to form a resulting film (1), wherein the extract is a coating material which comprises a binder and crosslinking agent that are the same as a binder or binders and crosslinking agent or agents in the aqueous basecoat material (A), (2) flashing off and/or drying the resulting film (1) without curing it completely, (3) coating the resulting flashed off and/or dried film (2) by pneumatic spray application at a spraying pressure less than the pneumatic spray in step (1) with an aqueous basecoat material which substantially corresponds or is identical to the at least one aqueous basecoat material (A) from which the basecoat (A) was produced to form a resulting aqueous basecoat film (3), (4) flashing off and/or drying the resulting aqueous basecoat film (3) without curing it completely, (5) coating the resulting flashed off and/or dried aqueous basecoat film (4) with at least one liquid clearcoat material to form at least one resulting clearcoat film, and (6) jointly curing the at least one resulting clearcoat film (5), the aqueous basecoat film (4), and the film (1), and, where present, any further uncured films that are present, wherein the process is used for overcoating an entire area of the multicoat paint system or for overcoating a defect to the multicoat paint system and all of the adjacent area up to a boundary.

2. The process of claim 1, wherein the multicoat paint system was produced by a wet on wet technique.

3. The process of claim 1, wherein the pneumatic spray application in step (3) is applied at a spraying pressure of from 0.3 to 2 bar.

4. The process of claim 1, wherein the whole area of the multicoat paint system is overcoated.

5. The process of claim 1, wherein the multicoat paint system is overcoated at a defect and also in an entire adjacent area up to a boundary.

6. The process of claim 1, wherein prior to step (1) at least one defect in the multicoat paint system is prepared by cleaning and/or abrading.

7. The process of claim 1, wherein the extract is completely free from pigments.

8. The process of claim 1, wherein the resulting film (1) in step (1) is applied in a total wet film thickness such that curing thereof in step (6) results in a dry film thickness of from 2 to 50 μm.

9. The process of claim 1, wherein the flashing off and/or drying of the resulting film (1) in step (2) and/or of the film (3) in step (4) is/are accelerated by raising the temperature of the films (1) and/or (3), passing a laminar air flow over the films (1) and/or (3), and/or reducing the humidity in the ambient atmosphere.

10. The process of claim 1, wherein the at least one clearcoat material in step (5) is applied with a spraying pressure of from 2.5 to 5 bar.

11. The process of claim 1, wherein the at least one clearcoat film applied in step (5) is flashed off prior to curing in step (6).

12. The process of claim 1, wherein the at least one clearcoat material comprises a one-component clearcoat material, a two-component clearcoat material, or a dual-cure clearcoat material.

13. The process of claim 1, wherein the at least one clearcoat material corresponds substantially or is identical to the at least one clearcoat material (B) from which the at least one clearcoat (B) of the multicoat paint system was produced.

14. The process of claim 12, wherein (i) the one-component clearcoat material comprises one of
  (a) a hydroxyl-containing binder and a crosslinking agent that is at least one of a blocked polyisocyanate, a tris(alkoxycarbonylamino)triazine, and/or an amino resin, or
  (b) at least one binder comprising a polymer containing pendant carbamate and/or allophanate groups and a crosslinking agent comprising an amino resin, (ii) the two-component clearcoat materials comprise a hydroxyl-containing binder and a crosslinking agent comprising a polyisocyanate, and (iii) the dual-cure clearcoat materials are one-component clearcoat materials or two-component clearcoat materials which additionally contain functional groups which can be activated with actinic radiation and/or additional constituents containing such functional groups.

15. The process of claim 1, wherein the motor vehicle is an automobile.

16. A process for overcoating a multicoat color and/or effect paint system, wherein the process is carried out on a line at an automaker's plant and wherein the multicoat color and/or effect paint system, which is an OEM finish on a motor vehicle produced by means of electrostatic spray application, comprises at least one color and/or effect basecoat (A) produced from at least one aqueous basecoat material (A) and at least one clearcoat (B) produced from at least one liquid clearcoat material (B), the process comprising:

(1) applying to an outer surface of the multicoat paint system by pneumatic spray application a clearcoat material that is an extract of an aqueous basecoat material, which substantially corresponds or is identical to the at least one aqueous basecoat material (A) from which the basecoat (A) was produced, to form a resulting film (1), wherein the extract is a coating material which comprises binder and crosslinking agent which is the same binder or binders and the same crosslinking agent or agents as in the aqueous basecoat material (A), except at lower concentrations than are employed in the aqueous basecoat material (A), (2) flashing off and/or drying the resulting film (1) without curing it completely, (3) coating the resulting flashed off and/or dried film (2) by pneumatic spray application at a spraying pressure less than the pneumatic spray in step (1) with an aqueous basecoat material which substantially corresponds or is identical to the at least one aqueous basecoat material (A) from which the basecoat (A) was produced, to form a resulting aqueous basecoat film (3), (4) flashing off and/or drying the resulting aqueous basecoat film (3) without curing it completely, (5) coating the resulting flashed off and/or dried aqueous basecoat film (4) with at least one liquid clearcoat material to form at least one resulting clearcoat film, and (6) jointly curing the at least one resulting clearcoat film (5), the aqueous basecoat film (4) and the film (1), and, where present, any further uncured films that are present, wherein the aqueous basecoat material (A) and the extract comprise at least one ionically and/or nonionically stabilized polyurethane binder which is saturated, unsaturated, and/or grafted with olefinically unsaturated compounds, wherein the aqueous basecoat material (A) and the extract further comprise at least one crosslinking agent selected from the group consisting of blocked polyisocyanates and tris(alkoxycarbonylamino)triazines, and wherein the process is used for overcoating an entire area of the multicoat paint system or for overcoating a defect to the multicoat paint system and all of the adjacent area up to a boundary.

17. The process of claim 16, wherein the pneumatic spray application in step (3) is conducted at a spraying pressure of from 0.3 to 1.8 bar, and the pneumatic spray application in step (1) is conducted with a spraying pressure of from 2.5 to 5 bar.

* * * * *